United States Patent [19]

Bibby

[11] Patent Number: 4,940,145

[45] Date of Patent: Jul. 10, 1990

[54] APPARATUS FOR SIZING PRODUCE AND THE LIKE

[76] Inventor: Max M. Bibby, 6826 Labish Center Rd. NE., Salem, Oreg. 97305

[21] Appl. No.: 785,017

[22] Filed: Oct. 7, 1985

[51] Int. Cl.[5] ..... B07B 13/04

[52] U.S. Cl. ..... 209/662; 209/669

[58] Field of Search ..... 209/662, 667, 668, 669, 209/659

[56] References Cited

U.S. PATENT DOCUMENTS

| | | | |
|---|---|---|---|
| 731,828 | 6/1903 | White | 209/662 |
| 1,139,714 | 5/1915 | Parker | 209/662 |
| 1,353,075 | 9/1920 | Sibley | 209/668 |
| 1,766,340 | 6/1930 | Kendall | 209/669 |
| 2,425,478 | 8/1947 | Lawton et al. | 209/669 |
| 2,506,848 | 5/1950 | Turner | 209/662 |
| 3,219,187 | 11/1965 | Ritze | 209/669 |
| 3,329,263 | 7/1967 | Rush et al. | 209/662 |
| 3,721,345 | 3/1973 | Brown et al. | 209/669 |

FOREIGN PATENT DOCUMENTS

| | | | |
|---|---|---|---|
| 64997 | 10/1892 | Fed. Rep. of Germany | 209/669 |
| 290489 | 4/1953 | Switzerland | 209/662 |

*Primary Examiner*—Donald T. Hajec

*Attorney, Agent, or Firm*—Olson & Olson

[57] ABSTRACT

A sizing apparatus for produce or the like comprises a framework supporting a plurality of vertically spaced levels of sizer assemblies comprising a number of horizontally spaced apart, rotating screw conveyors each cooperating with an associated adjustable sizer blade arranged to provide an equally sized opening between each screw and associated sizer blade on a level whereby to permit produce having a diameter smaller than the opening to fall through to the next lower sizing level. Each successive lower sizing level has progressively smaller sized openings in order that only successively smaller diameter produce may pass through the sizer openings. The sizing apparatus utilizes a specially configured screw conveyor in which each thread between adjacent crests is semi-circular in profile in order to facilitate the separation of produce according to its smallest diameter. The sizer blades are arranged so that the openings provided on a level are uniform and adjustable in unison and the sizing openings on each level are adjustable independently of the openings on other levels, whereby produce may be separated into any desired size category.

4 Claims, 2 Drawing Sheets

APPARATUS FOR SIZING PRODUCE AND THE LIKE

BACKGROUND OF THE INVENTION

This invention relates to produce sizers, and more particularly to a sizing apparatus which employs a plurality of screw transport conveyors each associated with an adjustable sizing plate and an opening therebetween arranged to permit selected sizes of produce to fall therethrough while larger sized produce, greater in diameter than the opening, is moved by the screw conveyor to it's outfeed end.

A produce sizer functions to separate a produce, for example onions, apples, oranges, peaches and the like into a plurality of sizes for packaging and marketing. All known types of produce sizers available heretofore suffer from structural limitations which tend to reduce their efficiency in accomplishing adequate separation of produce into size categories based on the smallest diameter of the produce. They also tend to scuff, abrade and otherwise damage the produce during the sizing operation. Such types of sizers are exemplified by U.S. Pat. Nos. 430,031; 1,655,422; 1,661,501; 3,329,263; and 3,451,084.

Briefly, U.S. Pat. No. 430,031 discloses a machine for sorting or sizing fruits and vegetables by passing the produce forwardly across an elongated space of progressively increasing sizes of rectangles formed between a fixed member and a rotary member, and in collecting the produce that drops through the first available corresponding size stage. The sizing surfaces of the rotary member and the cooperating fixed member are linear in configuration, and, since the sizing stages are formed integrally with each other, adjustment of each sizing stage without affecting the size opening of each other size stage is impossible. U.S. Pat. Nos. 1,655,422 discloses apparatus utilizing separating structure generally similar to that taught in U.S. Pat. No. 430,031.

U.S. Pat. No. 1,661,501 discloses a separating or classifying machine which is most typical of conventional grading equipment commonly found in the marketplace. A plurality of rollers are rotated in the same direction so that produce is lifted by one roller and forced downward by the other during the classifying operation. This construction has been found undesirable in its damaging effects on the produce.

U.S. Pat. No. 3,329,263 teaches that the rotation of rolls 40 and 41 relative to the intermediate partition 33 is such as to lift the root crop upward to help dislodge clinging material while moving the produce toward the outlet end and simultaneously allowing the escape of stones, mud and other debris. This device does not function to classify or size produce in any manner.

SUMMARY OF THE INVENTION

In its basic concept, this invention provides a sizing apparatus comprising a plurality of vertically spaced levels of transport screws of semi-circular profile and associated sizing blades having openings therebetween arranged to allow passage of produce of selected diameters to fall downwardly by gravity to successively lower sizing levels for further separation.

It is by virtue of the foregoing basic concept that the principal objective of this invention is achieved; namely, the accurate separation of bulk produce and the like into a plurality of discrete size categories based on smallest diameters while overcoming the disadvantages and limitations of sizing apparatus of the prior art.

Another object of this invention is the provision of a sizing apparatus of the class described which utilizes especially configured, semi-circular screw conveyors arranged to enhance separation of produce into discreet sizes according to the smallest diameter thereof.

Another object of this invention is the provision of a produce sizer of the class described which facilitates the separation of produce into any desired range of size categories by utilizing a construction by which the sizing openings on a level are uniformly adjustable independently of sizing openings on other levels.

A further object of this invention is the provision of a produce sizing apparatus of the class described which is of simplified construction for economical manufacture and efficient operation.

The foregoing and other objects and advantages of this invention will appear from the following detailed description, taken in connection with the accompanying drawings of a preferred embodiment.

DESCRIPTION OF THE PREFERRED EMBODIMENT

Figure 1:
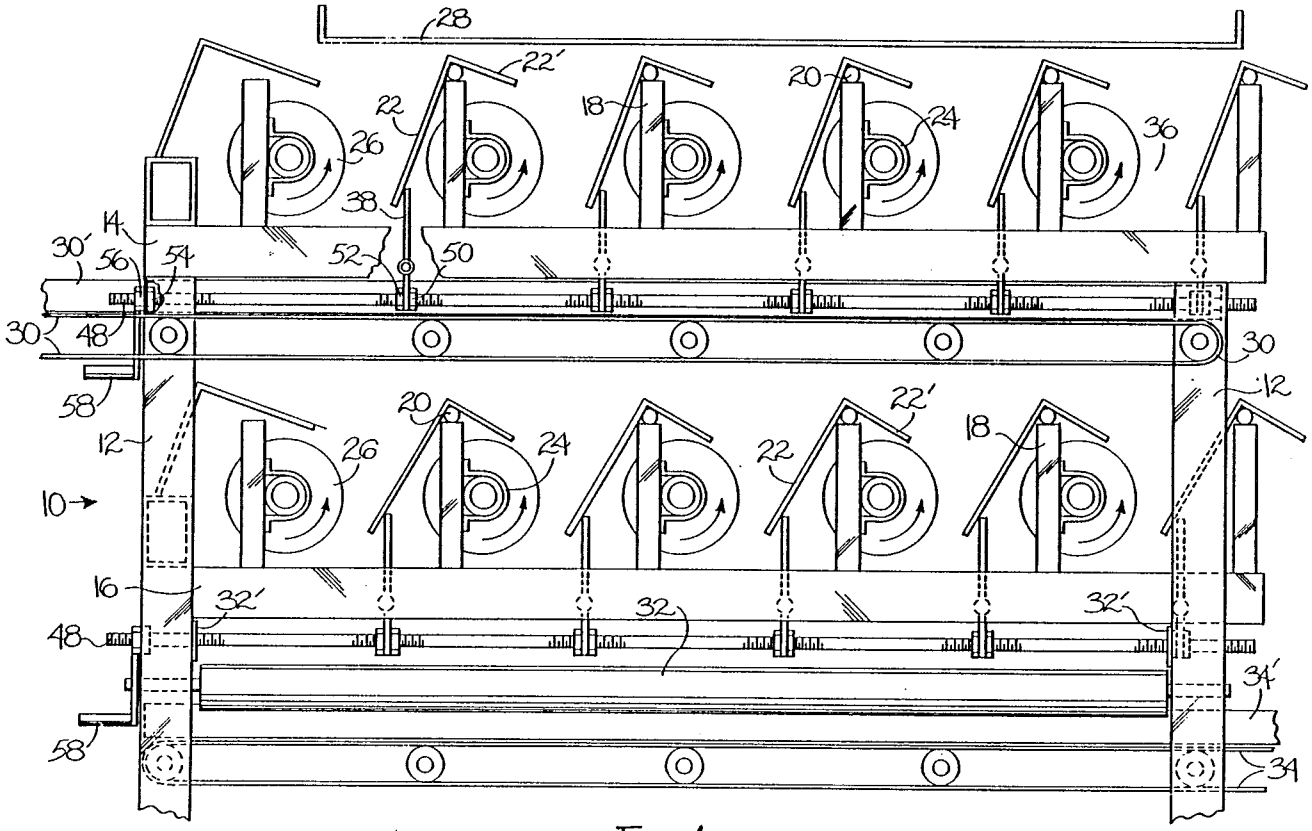
FIG. 1 is a fragmentary front elevation of a produce sizer embodying the features of this invention.

The produce sizing apparatus shown in the drawings embodies the features of this invention. In overview, this invention basically provides a produce sizing apparatus wherein harvested produce is delivered to its infeed end and is picked up by a plurality of horizontally spaced apart, especially configured screw conveyors, each of which cooperate with an adjustable sizing blade which is positioned relative to its associated screw so as to establish a selected space therebetween through which the largest desired size category of produce will not fall. This largest size produce consequently is transported, without compression, along the length of the screw conveyor to its outfeed end where the produce is deposited onto an outfeed conveyor means.

Produce which is smaller in size than is the selected space between the aforementioned sizer screw and associated sizer blade falls downwardly by gravity through the space to a lower sizing assembly level identical to the one described previously, with the exception that the sizer blades are adjusted so that the space between the blade and the screw is narrower, thereby permitting a second, smaller selected size of produce to be coveyed by that screw assembly to a second outfeed conveyor. Produce which is yet smaller in size that the space provided in the second sizer assembly level will fall between the sizer blades and the sizer screws either to an outfeed conveyor designated for smallest size produce or to additional vertically spaced sizing assembly levels such as described above but with progressively smaller size openings.

For purposes of the present description, the produce sizer apparatus embodied herein is illustrated as comprising two vertically spaced levels of sizing assemblies arranged to separate produce into three distint diameter size categories: large, medium and small. It will be understood of course that virtually any number of sizing levels may be provided in order to separate produce into any number of size categories as may be needed or desired. It will also be understood that although the sizing apparatus of this invention is intended primarily for use in sizing onions and various other types of edible produce, other generally similar sizing uses are possible.

Figure 2:
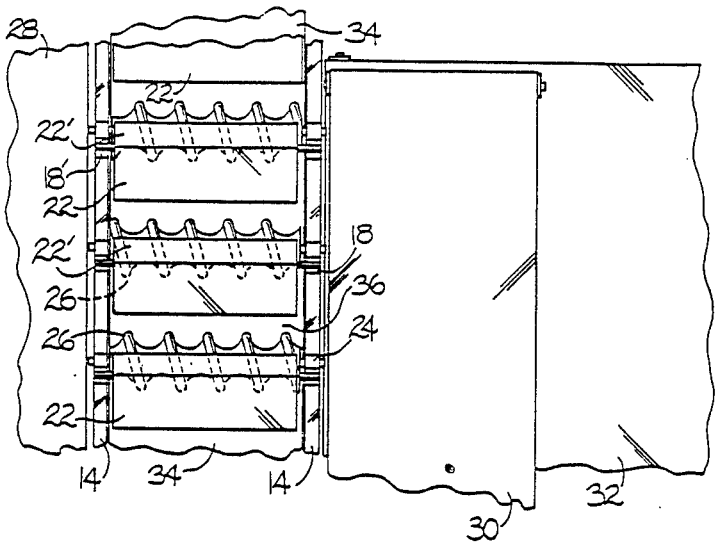
FIG. 2 is a fragmentary plan view of the produce sizer as viewed from the top in FIG. 1 and showing the arrangement of off-loading conveyors provided to remove separated sized produce.
Figure 3:
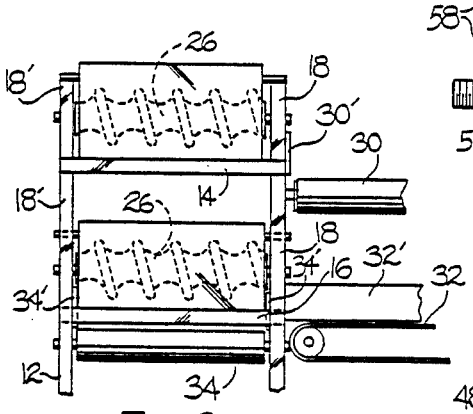
FIG. 3 is a fragmentary side view of the sizing apparatus of FIG. 2 as viewed from the bottom in FIG. 2.

With the basic structure and mode of operation of the present invention thus generally understood, reference is now made to the drawings, and in particular, FIGS. 1, 2 and 3. The sizing apparatus of this invention comprises a supporting framework 10 which, in this embodiment, includes corner uprights 12 arranged at their bottom ends to engage a base mount such as a floor, a platform or other suitable support. The upright assembly mounts, at preselected vertical levels, horizontal base members 14, 16 which provide means for mounting each respective level of sizing assemblies, as will become apparent later.

As seen in viewing FIGS. 1 and 2, each sizer level base 14, 16 mounts a plurality of longitudinally spaced pairs of upright support members 18, 18' at laterally spaced apart positions along the width of each level. As illustrated, each support member 18, 18' includes a pivot mount 20 at its upper end arranged to receive an adjustable sizer blade 22 as will be explained fully later. The uprights 18, 18' also mount bearings 24 configured to mount a rotatable produce screw conveyor 26 between opposite uprights, as seen best in FIG. 2. Hence, there is provided a framework which mounts a plurality of vertical sizing levels, 14, 16 each having a plurality of horizontally spaced apart, forwardly extending, rotatable screw conveyors 26 mounted thereon.

As seen at the top in FIG. 1, a delivery converyor 28 is arranged to introduce harvested produce in bulk to the infeed end of the uppermost sizer level 14. Also, in order to expedite automation, each sizer level is provided with an off-loading conveyor associated with the forward, outfeed end of each screw in that level. Hence, a largest size produce outfeed conveyor 30 with side rails 30' is shown in conjunction with the uppermost sizing level 14, a medium size produce conveyor 32 with side rails 32' associated with the lower sizer level 16, and a bottommost, small size produce conveyor 34 with side rails 34' is provided for receiving produce which has fallen past the lower sizing apparatus level 16.

The produce sizing apparatus embodied herein includes, as mentioned previously, a plurality of adjustable sizing blades 22, one blade associated with each lateral pair of upright members 18, 18'. As seen in FIG. 1, each blade is configured as an inverted L and is mounted at the juncture of it's legs 22, 22' to an upright by the pivot mount 20. In this manner, the long leg 22 of each blade is allowed to move arcuately about the axis of the blade pivot 20 toward and away from its associated screw conveyor 26, that being the screw mounted on the next adjacent lateral pair of uprights, in this embodiment to the left of the pair mounting a particular sizer blade. The space between the conveyor and the blade defines an opening 36 through which produce may freely pass. The short leg 22' of each blade 22 overlies the upper portion of the next adjacent screw 26 to prevent produce from being carried upwardly about the rotating screw to the underside of the long leg 22 of the blade.

It is to be understood that conventional drive means (not shown) engages each screw conveyor 26 in the apparatus so as to turn all screws on a level in a common direction. It is preferable that the direction of rotation of the screw conveyor is such that produce being carried by the screw conveyor is not forced downwardly through the opening provided between the screw and the sizer blade. In this regard, FIG. 1 illustrates with arrows that the direction of rotation of each screw is couterclockwise and hence the surface of each screw adjacent its corresponding blade is moving essentially upward so as to effectively lift the produce, rather than forcing it downward between the screw and the blade.

Consistent with that desired direction of rotation, the screw conveyor transports produce from its infeed end to its outfeed end when the drive means are turning the screws in the couterclockwise direction discussed above in connection with this embodiment. Thus, produce that is larger in diameter than is the opening 36 provided between the screw and the sizer blade will be moved along the length of the screw in a manner which prevents any binding of the produce or forces any downward movement of the produce through the opening. Hence, produce which is of sufficient size as to not fall downwardly freely through the opening will be transported without compression across the width of the level 14 and subsequently deposited onto the off-loading conveyor 30 designated for largest size produce.

Figure 4:
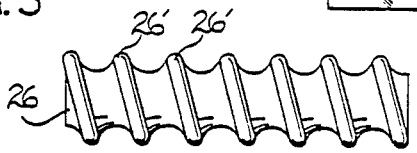
FIG. 4 is a plan view of a specially configured screw conveyor having a semi-circular thread profile between crests.

Referring now to FIG. 4, the produce sizer of this invention preferably utilizes a specially configured scew 26 which has been found to significantly improve the sizing process while also significantly reducing the occurrence of damage to the produce during sizing. As will be apparent from FIG. 4, the thread between each crest 26' is substantially semi-circular in profile. Experimentation has shown that this configuration greatly improves the separation of produce according to the smallest diameter of the produce moving along the conveyor. In this regard, since the thread of the screw provides a substantially true diameter, and the upwards lifting action of the screw encourages somewhat of a tumbling action, the produce will eventually acquire a position in which its smallest diameter will register with the semi-circular opening of the screw. This is a feature which has been shown to be significantly more effective than the flat surfaces of conventional sizing apparatus using typical screw conveyors.

Figure 5:
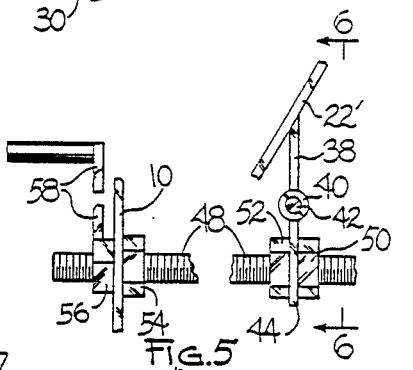
FIG. 5 is a fragmentary, foreshortened front elevation, on an enlarged scale, of the sizer blade adjustment mechanism shown in FIG. 1.
Figure 6:
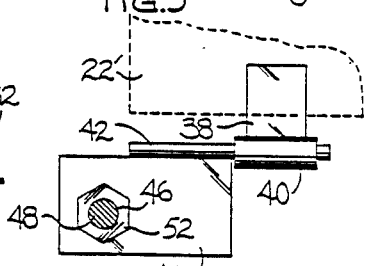
FIG. 6 is a fragmentary sectional view of the blade adjustment mechanism of FIG. 5 taken along the line 6—6 in FIG. 5.

Referring now once again to the sizer blades 22, means is provided for securing them for adjustment of the angular disposition of each blade on their mount 20 to their respective upright member in order to selectively control the size of the opening 36 allowed between the blade and its associated screw. In the embodiment illustrated, the bottom end of each sizer blade on a level is connected to a common adjusting rod so that the blade's angular disposition and the resulting sizing opening are equal along a level. In the arrangement illustrated in FIGS. 1, 5 and 6, each adjustable sizer blade leg 22 has rigidly secured adjacent its bottom end a downwardly extending support member 38 mounting one component of a pivot bearing, shown for purposes of illustration herein as a hollow pipe 40. The corresponding component of the pivot, illustrated herein as a rod 42 arranged to be rotatably received within the pipe 40, is rigidly mounted to a plate member 44 which is provided with a transverse bore 46.

As seen best in FIG. 1, an adjustment shaft 48 is mounted on the framework for longitudinal movement and arranged to extend the length of the sizing level. The shaft is received through the bore 46 in each plate member 44 associated with a sizing plate 22 on the level. In the embodiment illustrated, the shaft 48 is threaded and backup nuts 50, 52 are provided on opposite sides of each plate member 44 to secure the latter non-movably in a desired present position along the length of the shaft 48. In this manner, each individual sizing blade 22 may be adjusted independently in order to assure that each blade on a level will have the same angular disposition as the other blades on that level. Hence, once individually adjusted, the produce sizing openings 36 on a level are all equal in width, and may be adjusted in unison by moving the shaft 48 longitudinally, to change all the openings 36 equally.

Means is provided to move the adjusting shaft 48 longitudinally and lock it into a desired position of longitudinal adjustment. In the embodiment illustrated in FIGS. 1 and 5, the shaft 48 extends through an opening in the framework 10 and backup nuts 54, 56 are provided on the shaft to capture opposite sides of the framework therebetween. By loosening the nut 54 and turning the other nut 56, the shaft 48 will be moved to the left in FIG. 5. Conversely, by backing off the nut 56 and turning the other nut 54 in the appropriate direction, the shaft will move in the opposite direction. When positioned as desired, the nuts will be tightened in order to prevent further longitudinal movement of the shaft. A handle 58 may be attached to the backup nut 65 if desired to facilitate the adjustment process.

Thus, it is understood that each adjustable blade 22 on a level is positioned so that an equally sized opening 36 is achieved between each of the sizing blades and associated screws on that level and that the same is true for all subsequent lower sizing levels of the apparatus. Each of the assemblies on the uppermost level are adjusted to create an opening which is slightly smaller than is the diameter of the largest size produce desired to be separated out of a bulk quantity. Hence, produce having a smaller diameter will simply fall downwardly through the openings 36 to the next lower sizing level. Obviously, the sizing blades associated with this second sizing level are adjusted so as to provide a smaller sized opening 36 between the blade and the screw through which all but a next larger size of produce will fall. As many sizing levels as may be desired can be provided in order to accomplish the separation of bulk produce into as many size categories as may be needed.

From the foregoing it will be apparent that the sizing apparatus of this invention utilizes structure which accomplishes a very accurate and detailed sizing operation heretofore unavailable through use of sizing apparatus of the prior art. The passage of successively smaller sized produce through successive sizer stages, each subsequent stage separating out progressively smaller diameters, affords the user a very accurate division of produce to marketing. Also, unlike the sizers of the prior art, the sizing blades on any level may be quickly and very easily adjusted for a desired size while not affecting the size adjustment for other levels. Hence, the particular size categories desired are completely independent of other size categories.

Another distinguishing feature of construction of the present invention is its vertically disposed sizing levels which require that all produce to acted upon by the uppermost sizing level and all subsequent lower levels through which the produce may pass. In this manner, the occurrence of an improper sizing is virtually eliminated.

From the foregoing it will be apparent to those skilled in the art that various changes, other than those previously mentioned, may be made in the size, shape, type, number and arrangement of parts described hereinbefore without departing from the spirit of this invention and the scope of the appended claims. For example, it may be desirable to separate produce or the like into only two size categories, in which case only one level of sizing assemblies would be provided. Conversely, should a wide range of selected sizes be desired to be separated out of a bulk quantity of material, more than the two levels shown may be provided in order to accomplish the desired result. Also, the size and the particular configuration, or the number of flights of the screws may be changed in order to suit particular need. Additionally, although the short leg 22' of the sizer blade is desirable in order to prevent produce from inadvertently traveling about the screw conveyor and becoming lodged on the opposite side of the screw, other blade configurations are possible without departing from the intent of the teaching herein. Also, the particular blade adjusting mechanism illustrated is intended to suggest a preferred means by which the size openings 36 may be adjusted. Other suitable arrangements may be used to provide means by which the blades on a level may be adjusted in unison.

Having thus described my invention and the manner in which it may be used, I claim:

1. A sizing apparatus for produce comprising:
(a) a vertically extending framework,
(b) at least one substantially horizontal sizing level base mounted on the framework,
(c) a plurality of rotary driven screw conveyors on said sizing level base arranged in longitudinally extending condition and disposed at laterally spaced apart intervals, each said screw conveyor configured with a thread having a substantially semi-circular profile betwen crests, and
(d) a sizer blade mounted adjacent each said rotary driven screw conveyor and disposed to establish a sizing opening between it and its associated screw, the openings being of uniform size on a level whereby to allow produce and the like of smaller diameter to fall downwardly therethrough by gravity.

2. A sizing apparatus for produce comprising:
(a) a vertically extending framework,
(b) a plurality of substantially horizontal sizing levels on the framework at vertically spaced apart intervals thereon,
(c) a plurality of rotary driven screw conveyors mounted on each sizing level in longitudinally extending condition and disposed at laterally spaced apart intervals, each said screw conveyor configured with a thread having a substantially semi-circular profile between crests, and (d) a sizer blade mounted adjacent each said rotary driven screw conveyor on each level and disposed to establish a sizing opening between it and its associated screw, the openings being of uniform size on a level and the openings on one level being smaller than the openings through its next adjacent upper vertically spaced level.

3. The sizing apparatus of claim 2 including adjustment means engaging the sizing blades on a level for moving them simultaneously into various equally sized positions relative to their associated screw conveyors for adjusting the size of the opening therebetween independently of the openings provided through other levels.

4. The sizing apparatus of claim 2 wherein each screw conveyor is configured so that its direction of rotation moves its surface adjacent the opening upwardly, whereby to lift produce upwardly away from said opening.

* * * * *